US007949267B2

(12) United States Patent
Nakasha

(10) Patent No.: US 7,949,267 B2
(45) Date of Patent: May 24, 2011

(54) IMAGE FORMING APPARATUS HAVING AN ADJUSTMENT UNIT FOR ADJUSTING A CONTACT STATE BETWEEN TWO MEMBERS

(75) Inventor: Shinya Nakasha, Tokyo (JP)

(73) Assignee: Oki Data Corporation, Tokyo (JP)

( * ) Notice: Subject to any disclaimer, the term of this patent is extended or adjusted under 35 U.S.C. 154(b) by 365 days.

(21) Appl. No.: 12/219,889

(22) Filed: Jul. 30, 2008

(65) Prior Publication Data

US 2009/0047031 A1 Feb. 19, 2009

(30) Foreign Application Priority Data

Aug. 17, 2007 (JP) ..... 2007-212961

(51) Int. Cl.
*G03G 15/00* (2006.01)
*G03G 15/08* (2006.01)

(52) U.S. Cl. ..... 399/44; 399/265; 399/279

(58) Field of Classification Search ..... 399/43, 399/44, 119, 265, 279–286, 411
See application file for complete search history.

(56) References Cited

U.S. PATENT DOCUMENTS 5,640,651 A * 6/1997 Katoh et al. ..... 399/119
2003/0026629 A1* 2/2003 Kawamura et al. ..... 399/281
2005/0207769 A1* 9/2005 Matsuda et al. ..... 399/53

FOREIGN PATENT DOCUMENTS

JP 05204249 A * 8/1993
JP 2002-108089 4/2002

* cited by examiner

*Primary Examiner* — David M Gray
*Assistant Examiner* — Joseph S Wong
(74) *Attorney, Agent, or Firm* — Rabin & Berdo, PC

(57) ABSTRACT

An image forming apparatus is provided that has a developing agent holder arranged as opposed to an image holder having an electrostatic latent image formed thereon, the developing agent holder attaching the developing agent to the image holder, a developing agent supplying unit rotatably arranged in contact with the developing agent holder, the developing agent supplying unit supplying a developing agent to the developing agent holder, an adjustment unit capable of adjusting a contacting state between the developing agent holder and the developing agent supplying unit.

14 Claims, 16 Drawing Sheets

DEVELOPING DEVICE
WHEN SUPPLY ROLLER IS WORN OUT

DEVELOPING DEVICE AT INITIAL STATE (mm)

| | COLOR | OPPOSITE SIDE TO GEAR SIDE | CENTER | GEAR SIDE | AVERAGE EXTERNAL DIAMETER |
|---|---|---|---|---|---|
| INITIAL STATE | BLACK | 15.81 | 16.25 | 15.84 | 15.97 |
| | YELLOW | 15.82 | 16.31 | 15.85 | 15.99 |
| | MAGENTA | 15.83 | 16.32 | 15.81 | 15.99 |
| | CYAN | 15.80 | 16.27 | 15.84 | 15.97 |
| | | | | AVERAGE | 15.98 |
| END OF LIFE | BLACK | 15.64 | 16.17 | 15.72 | 15.84 |
| | YELLOW | 15.64 | 16.21 | 15.63 | 15.83 |
| | MAGENTA | 15.71 | 16.23 | 15.71 | 15.88 |
| | CYAN | 15.70 | 16.25 | 15.77 | 15.90 |
| | | | | AVERAGE | 15.86 |
| DIFFERENCE BETWEEN INITIAL STATE AND END OF LIFE | BLACK | 0.17 | 0.08 | 0.12 | 0.12 |
| | YELLOW | 0.19 | 0.09 | 0.21 | 0.16 |
| | MAGENTA | 0.11 | 0.09 | 0.11 | 0.10 |
| | CYAN | 0.10 | 0.02 | 0.07 | 0.06 |
| | | | | AVERAGE | 0.11 |

SUPPLY ROLLER PRESSING STATE (IN IMAGE FORMING APPARATUS)

SUPPLY ROLLER DETACHED FROM DEVELOPING DEVICE

| DV POTENTIAL | NIP PORTION PUSHING DEPTH | | |
|---|---|---|---|
| | −0.1mm | REFERENCE POSITION | +0.1mm |
| NN | −57V | −87V | −60V |
| HH | −39V | −47V | −12V |
| LL | −91V | −80V | −62V |

FIG. 9A

| FAINT SPOTS | NIP PORTION PUSHING DEPTH | | |
|---|---|---|---|
| | −0.1mm | REFERENCE POSITION | +0.1mm |
| NN | ○ | ○ | ○ |
| HH | ○ | ○ | × |
| LL | ○ | ○ | ○ |

FIG. 9B

| 2×2 SMEARS | NIP PORTION PUSHING DEPTH | | |
|---|---|---|---|
| | −0.1mm | REFERENCE POSITION | +0.1mm |
| NN | ○ | ○ | |
| HH | ○ | ○ | ○ |
| LL | × | ○ | ○ |

FIG. 9C

LL ENVIRONMENT

HH ENVIRONMENT

A CASE WHERE TONER POTENTIAL OF DEVELOPING ROLLER IS PERCEIVED AS HIGH

A CASE WHERE TONER POTENTIAL OF DEVELOPING ROLLER IS PERCEIVED AS LOW

IMAGE FORMING APPARATUS HAVING AN ADJUSTMENT UNIT FOR ADJUSTING A CONTACT STATE BETWEEN TWO MEMBERS

BACKGROUND OF THE INVENTION

1. Field of the Invention

The invention relates to an image forming apparatus that forms characters and images on a predetermined recording medium by fixing toner thereto.

2. Description of Related Art

Generally, an image forming apparatus forming characters and images on a predetermined recording medium by fixing toner thereto performs following steps to form an image. First, the image forming apparatus forms an electrostatic latent image on a surface of a photosensitive drum serving as an image holder with an exposure device such as LED (Light Emitting Diode) head and the like. Then, the formed electrostatic latent image is developed with toner including colorant, and the obtained visible image is transferred to a recording medium such as recording paper and the like. Thus, the image is formed on the recording medium.

To develop the electrostatic latent image with the toner including colorant, the image forming apparatus has a developing roller for attaching the toner to the electrostatic latent image formed on the photosensitive drum and a toner supply roller for supplying the toner to the developing roller. A potential difference between the toner supply roller and the developing roller causes charged toner to be supplied from the toner supply roller to the developing roller at a contacting portion formed by the toner supply roller and the developing roller overlapping with each other (this portion is hereinafter referred to as a NIP portion pushing depth).

For example, both of the toner supply roller and the developing roller are secured, and an axial distance between the toner supply roller and the developing roller is configured as a constant interval, as disclosed in Japanese Patent Application Publication No. 2002-108089.

SUMMARY OF THE INVENTION

As hereinabove described, the axial distance between rotational axes of the toner supply roller and the developing roller is configured as a constant interval, and thus, in a case where the NIP portion pushing depth is not appropriate for a usage condition, toner charging condition may become abnormal and deteriorate image quality.

This aspect of the invention is made in consideration of such situations, and it is the object of an aspect of the invention to provide an image forming apparatus that can always keep a most suitable interval between a toner supply roller and a developing roller by moving the toner supply roller even in a case where the NIP portion pushing depth is inappropriate due to usage situations such as secular change.

To alleviate the above problems, the image forming apparatus has a developing agent holder arranged as opposed to an image holder having an electrostatic latent image formed thereon, the developing agent holder attaching the developing agent to the image holder, a developing agent supplying unit rotatably arranged in contact with the developing agent holder, the developing agent supplying unit supplying a developing agent to the developing agent holder, an adjustment unit capable of adjusting a contacting state between the developing agent holder and the developing agent supplying unit.

The image forming apparatus according to an aspect of the invention has the adjustment unit capable of adjusting a contacting state between the developing agent holder and the developing agent supplying unit. That is, the adjustment unit moves the developing agent supplying unit and adjusts the distance therebetween so that the distance becomes normal.

The image forming apparatus according to an aspect of the invention can adjust the NIP portion pushing depth by moving the developing agent supplying unit and keeping the most suitable distance between the developing agent holder and the developing agent supplying unit even in a case where the NIP portion pushing depth is displaced due to usage situations such as an infant mortality failure of the developing agent supplying unit, an abrasion of roller portions caused by usage over many years, an environment in which the image forming apparatus is used, and the like. Thus, the image forming apparatus according to an aspect of the invention can alleviate deterioration in the image quality caused by abnormally charged developing agent on the developing agent holding unit.

DETAILED DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein:

FIG. 4A shows the developing device at initial state;

FIG. 4B shows the developing device when the toner supply roller is worn out;

FIG. 9A is a table showing a measurement result of the toner potential changed in accordance with the change in the NIP portion pushing depth and the environment;

FIG. 9B is a table showing an experiment result of faint spots appearing in accordance with the changes in the NIP portion pushing depth and the environment;

FIG. 9C is a table showing an experiment result of 2×2 smears appearing in accordance with the changes in the NIP portion pushing depth and the environment;

PREFERRED EMBODIMENTS

First Embodiment

Figure 1:
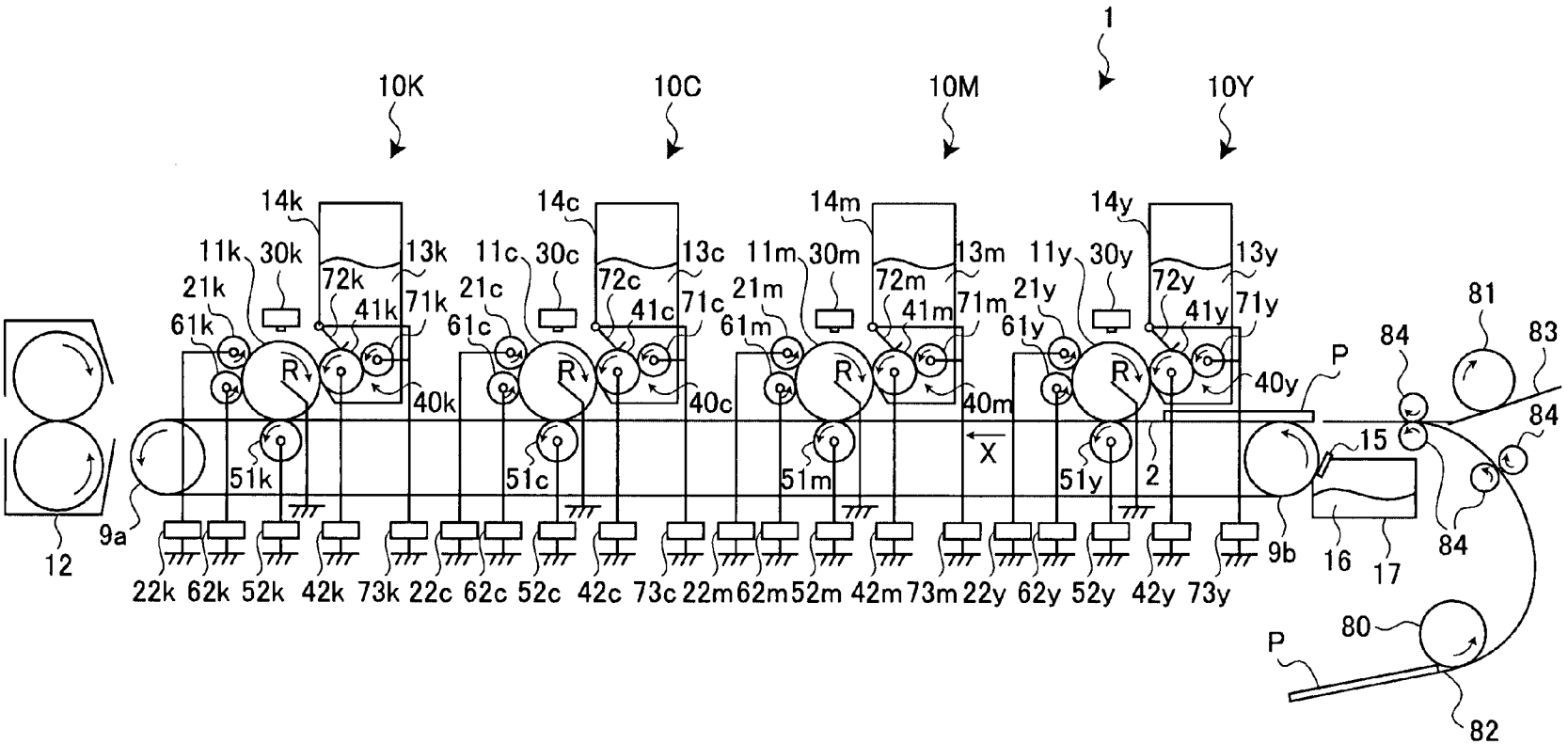
FIG. 1 is a cross sectional diagram describing a structure of an essential portion of an image forming apparatus according to the first embodiment of the present invention.

FIG. 1 is a cross sectional view describing an essential structure in an image forming apparatus 1 according to the first embodiment. The image forming apparatus 1 has a transfer belt 2, a driving roller 9*a*, a driven roller 9*b*, image forming units 10Y, 10M, 10C, 10K, photosensitive drums 11*y*, 11*m*, 11*c*, 11*k*, a fusing device 12, toners 13*y*, 13*m*, 13*c*, 13*k*, toner cartridges 14*y*, 14*m*, 14*c*, 14*k*, a belt cleaning blade 15, a discarded toner 16, a discarded toner box 17, charging rollers 21*y*, 21*m*, 21*c*, 21*k*, charging device power sources 22*y*, 22*m*, 22*c*, 22*k*, exposure devices 30*y*, 30*m*, 30*c*, 30*k*, developing rollers 41*y*, 41*m*, 41*c*, 41*k*, developing device power sources 42*y*, 42*m*, 42*c*, 42*k*, transfer rollers 51*y*, 51*m*, 51*c*, 51*k*, transfer device power sources 52*y*, 52*m*, 52*c*, 52*k*, cleaning rollers 61*y*, 61*m*, 61*c*, 61*k*, cleaning device power sources 62*y*, 62*m*, 62*c*, 62*k*, toner supply rollers 71*y*, 71*m*, 71*c*, 71*k*, layer formation blades 72*y*, 72*m*, 72*c*, 72*k*, toner supply device power sources 73*y*, 73*m*, 73*c*, 73*k*, a hopping roller 80, an MPT (Multi Purpose Tray) hopping roller 81, a tray 82, an MPT tray 83, a drive roller 84, and a recording paper P serving as a recording medium.

The transfer belt 2 forms a medium conveyance path in which the stacked recording paper P is horizontally conveyed by a rotational driving force of the driving roller 9*a* and the driven roller 9*b*.

The image forming units 10Y,10M,10C,10K have the same structure as each other except that the toners 13*y* (yellow), 13*m* (magenta), 13*c* (cyan), 13*k* (black) contained in the toner cartridges 14*y*, 14*m*, 14*c*, 14*k*, respectively, are different from each other. Thus, the structure of only the image forming unit 10Y using the yellow toner will be hereinafter described to represent all of the image forming units. The image forming unit 10Y has the photosensitive drum 11*y*, serving as an organic electrostatic latent image holder, having an organic photosensitive on the surface thereof.

On the periphery of the photosensitive drum 11*y*, the charging roller 21*y* serving as a charging device charging the photosensitive drum 11*y* is arranged to be in contact with the photosensitive drum 11*y*. The charging roller 21*y* charges the photosensitive drum 11*y* in contact with the charging roller 21*y* with an application of a positive voltage or a negative voltage from the predetermined charging device power source 22*y*.

Furthermore, on the periphery of the photosensitive drum 11*y*, the exposure device 30*y* is arranged to form the electrostatic latent image on the surface of the photosensitive drum 11*y*. The exposure device 30*y* forms the electrostatic latent image by emitting a light corresponding to an image signal onto the surface of the photosensitive drum 11*y*. For example, a combination of an LED (Light Emitting Diode) array and a so-called lens array, a combination of a laser and an image formation optical system, and the like may be arbitrarily used as the exposure device 30*y*.

Furthermore, on the periphery of the photosensitive drum 11*y*, the developing roller 41*y* serving as a developing agent holder developing the electrostatic latent image formed on the photosensitive drum 11*y* is arranged to be in contact with the photosensitive drum 11*y*. A positive voltage or a negative voltage is applied from a predetermined developing device power source 42*y* to the developing roller 41*y*. A potential difference between the electrostatic latent image formed on the photosensitive drum 11*y* and the toner on the developing roller 41 causes the toner on the developing roller 41 to attach to the photosensitive drum 11*y*, thus forming a toner image thereon.

On the developing roller 41*y*, the layer formation blade 72*y* serving as a toner regulation member keeping a toner amount constant is so arranged that one end of the layer formation blade 72*y* is in contact with the developing roller 41*y*. Furthermore, on the developing roller 41*y*, the toner supply roller 71*y* (a developing agent supplying unit) serving as a toner supply device is arranged to be in contact with the developing roller 41*y*. A positive voltage or a negative voltage is applied from the predefined toner supply device power source 73*y* to the layer formation blade 72*y* and the toner supply roller 71*y*. The developing roller 41*y*, the layer formation blade 72, and the toner supply roller 71*y* as described above make up the developing device 40*y*.

Furthermore, on the periphery of the photosensitive drum 11*y*, the transfer roller 51*y* serving as a transfer device transferring the toner image onto the recording paper P is arranged to be in contact with a back surface of the transfer belt 2. A positive voltage or a negative voltage is applied from the transfer device power source 52*y* to the transfer roller 51*y* and the recording paper P placed on the transfer belt 2 is sandwiched and conveyed between the transfer roller 51*y* and the photosensitive drum 11*y*. This transfer voltage causes the toner image to be transferred to the recording paper P.

On the periphery of the photosensitive drum 11*y*, the cleaning roller 61*y* is arranged to be in contact with the photosensitive drum 11*y*. The cleaning roller 61*y* serves as a cleaning device collecting residual toner after the transfer. The cleaning roller 61*y* is consisted of a metal shaft and a porous sponge. A positive voltage or a negative voltage is applied from the predetermined cleaning device power source 62*y* to the cleaning roller 61*y*, so that the cleaning roller 61*y* collects the residual toner remaining on the photosensitive drum 11*y*.

The image forming unit 10Y as described above develops the electrostatic latent image formed on the photosensitive drum 11*y* with the yellow toner, and transfers the obtained toner image onto the recording paper P placed on the transfer belt 2. Each motor, not shown in the figures, driving each roller and each power source in the image forming unit 10Y is controlled by a later-described printing control unit 99.

It should be noted that each unit in the image forming unit 10M using magenta toner, the image forming unit 10C using cyan toner, and the image forming unit 10K using black toner is denoted with a reference numeral of each unit in the image forming unit 10Y in which a suffix "y" is replaced with a suffix m, c, and k, respectively. In a case where a unit of the image forming units 10Y, 10M, 10C, and 10K is generally referred to in the below description, the reference numeral is recited without the alphabetical suffix to represent an identical unit in each of the image forming units 10Y, 10M, 10C, and 10K.

In the image forming apparatus 1, the belt cleaning blade 15 serving as a cleaning device for the transfer belt 2 is arranged on the periphery of the driven roller 9*b* to be in contact with the transfer belt 2. The discarded toner 16 scraped off by the belt cleaning blade 15 is collected in the discarded toner box 17. The belt cleaning blade 15 is consisted of an elastic plate, and scrapes off the residual toner remaining on the transfer belt 2 by making an edge portion thereof be in contact with the transfer belt 2.

Furthermore, the image forming apparatus 1 has the fusing device 12 downstream in the medium conveyance path of the transfer belt 2. The fusing device 12 is consisted of two rollers arranged in parallel and in contact with each other, one above and one below. A heat and pressure applied to the contacting surface between these rollers causes the toner image transferred onto the recording paper P to be fixed thereon. Finally, the recording paper P is delivered out of the image forming apparatus 1.

The image forming apparatus 1 has the tray 82 and the MPT tray 83 storing the recording paper P. The recording paper P picked up by the hopping roller 80 from the tray 82 is forwarded to the transfer roller 2 by the driving roller 84. On the other hand, the recording paper P picked up by the MPT hopping roller 81 from the MPT tray 83 is forwarded to the transfer roller 2 by the drive roller 84.

The transfer belt 2 conveys the recording paper P in a direction of the arrow X in FIG. 1 at a predefined medium conveyance speed according to the rotation of each of the driving roller 9*a* and the driven roller 9*b*. Accordingly, the four image forming units 10Y, 10M, 10C, and 10K form toner images in each color on the photosensitive drums 11*y*, 11*m*, 11*c*, and 11*k*, respectively, and transfer the toner images onto the recording paper P in sequence. The transferred toner images are collectively fixed by the fusing device 12, so that a color image is formed.

Figure 2:
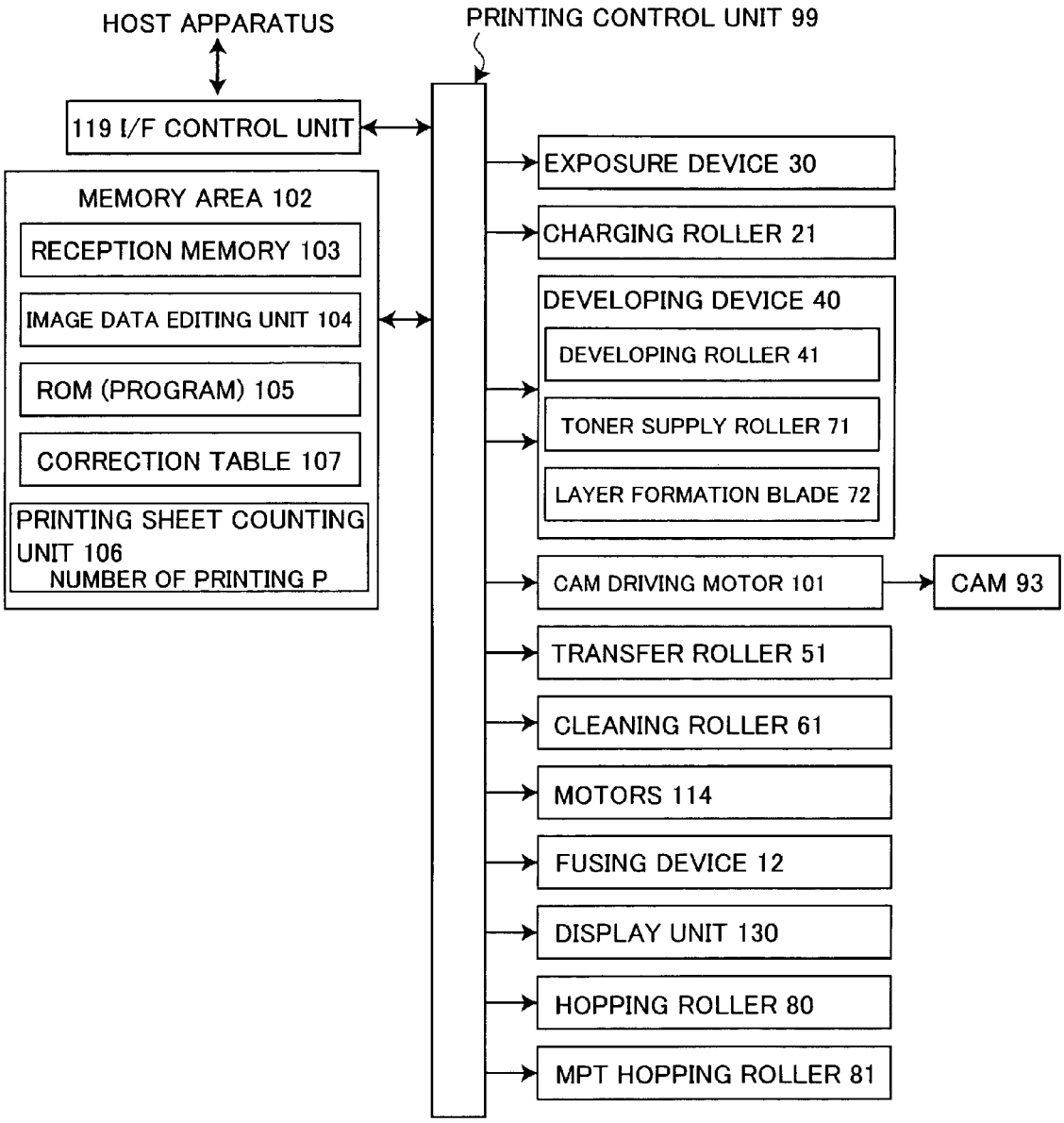
FIG. 2 is a block diagram describing a circuit configuration for a printing control according to the first embodiment of the present invention.

FIG. 2 is a block diagram describing a circuit configuration for a printing control according to the present embodiment. The image forming apparatus 1 has the printing control unit 99, an I/F control unit 119, a memory area 102 consisting of a reception memory 103, an image data editing unit 104, a ROM (Read Only Memory) 105, a printing sheet counting unit 106, a correction table 107, and the like, the exposure device 30, the charging roller 21, the developing device 40 consisting of the developing roller 41, the toner supply roller 71, the layer formation blade 72, and the like, a cam driving motor 101 driving a cam 94, the transfer roller 51, the cleaning roller 61, motors 114 rotating rollers, the fusing device 12, a display unit 130, the hopping roller 80, and the MPT hopping roller 81.

The printing control unit 99 is consisted of a CPU (Central Processing Unit) not shown in the figures, and controls the entire image forming apparatus 1 by executing a program stored in the ROM 105 and the like.

The I/F control unit 119 is a connection means for connecting with a host apparatus such as an external host personal computer and the like. Various connections means regardless of cable or wireless can be used as the I/F control unit 119.

The memory area 102 has almost the same function as a memory area equipped with an ordinary electrophotographic image forming apparatus, and is a memory area consisted of a RAM (Random Access Memory) and the like. The reception memory 103 is a memory area, serving as a work area for the printing control unit 99, in which image data received from the host apparatus via the I/F control unit 119 is temporarily memorized. The image data editing unit 104 is a memory area that functions as a work area when the image data is edited based on a control of the printing control unit 99. The ROM 105 not only stores a printing operation control program executed by the printing control unit 99, but also stores a processing program for adjusting the NIP portion pushing depth formed by the developing roller 41 and the toner supply roller 71 as described later. The printing sheet counting unit 106 temporarily memorizes the counted number of printing. The correction table 107 stores parameters and the like for optimizing a distance between rotational axes of the developing roller 41 and the toner supply roller 71 according to a result of the number of printing counted by the printing sheet counting unit 106 as described later.

Next, an image forming process performed by the image forming apparatus 1 will be hereinafter described. When a printing instruction is inputted to the printing control unit 99 of the image forming apparatus 1 via the I/F control unit 119, the printing control unit 99 gives an instruction to pick up the recording paper P, sheet by sheet, by driving the hopping roller 80 or the MPT hopping roller 81.

Simultaneously with this, the printing control unit 99 gives an instruction to apply a direct-current charging voltage from the charging device power source 22*y* to the charging roller 21*y*. The voltage applied to the charging roller 21*y* charges the photosensitive drum 11*y*. The printing control unit 99 gives an instruction to apply a direct-current voltage, in the polarity opposite to the voltage applies to the charging roller 21*y*, from the transfer device power source 52*y* to the transfer roller 51*y*. The printing control unit 99 gives an instruction to apply a direct-current voltage, in the same polarity as the voltage applies to the charging roller 21*y*, from the developing device power source 42*y* to the developing roller 41*y*. The printing control unit 99 gives an instruction to apply a direct-current voltage, in the same polarity as the voltage applied to the charging roller 21*y*, from the toner supply device power source 73*y* to the toner supply roller 71*y* and the layer formation blade 72*y*. The printing control unit 99 gives an instruction to apply a direct-current voltage, in the polarity opposite to the voltage applied to the charging roller 21*y*, from the cleaning device power source 62*y* to the cleaning roller 61*y*.

Next, the printing control unit 99 gives the exposure device 30*y* an instruction to form the electrostatic latent image by emitting the light corresponding to the image data to the surface of the charged photosensitive drum 11*y*. At this moment, the voltage in a portion of the surface of the photosensitive drum 11*y* having the electrostatic latent image formed thereon drops to approximately 0V because the light has been emitted onto the portion by the exposure device 30*y*. The surface of the photosensitive drum 11*y* having the electrostatic latent image formed thereon comes in contact with the developing roller 41, as the photosensitive drum continues to rotate in a direction of the arrow R as shown in FIG. 1. Here, the toner on the developing roller 41*y* is charged to the same polarity as the charging voltage of the charged surface of the photosensitive drum 11*y*, and thus, the toner on the developing roller 41*y* attaches to the electrostatic latent image portion on the surface of the photosensitive drum 11*y* due to electrostatic effect.

The transfer roller 51*y* causes the transfer belt 2 to be charged to a voltage in the polarity opposite to the voltage applied to the charging roller 21*y*, and thus, the toner image developed by the toner supplied from the developing roller 41*y* is transferred onto the recording paper P when the surface of the developing roller 11*y* comes in contact with the recording paper P.

In this way, the recording paper P having the toner image transferred thereon is driven by the transfer belt 2 and is conveyed to the image forming unit 10M arranged in a subsequent section. Such processing is also done by the image forming units 10C, 10K in sequence. Finally, after the fusing step is completed by the fusing device 12, the recording paper P is discharged as a printed material to the outside of the image forming apparatus 1. At this moment, the printing sheet counting unit 106 adds one to the number of printing already memorized, and memorizes the new number of printing as the total number of printing.

Here, the residual toner remaining on the transfer belt 2 during printing of the recording paper P is conveyed in a direction of the arrow X in FIG. 1, and is scraped off by the cleaning blade 15 arranged on the periphery of the driven roller 9*b* and is accumulated in the toner box 17. After this series of processings is completed, the image forming apparatus 1 finishes the printing operation.

In addition to the exposure device 30, the charging roller 21, the developing device 40, the cam driving motor 101, the transfer roller 51, the cleaning roller 61, the motors 114, the fusing device 12, the hopping roller 80, and the MPT hopping roller 81, the printing control unit 99 controls the display unit 130 to display the image data received from the host apparatus and the image data edited by the image editing unit.

Figure 3:
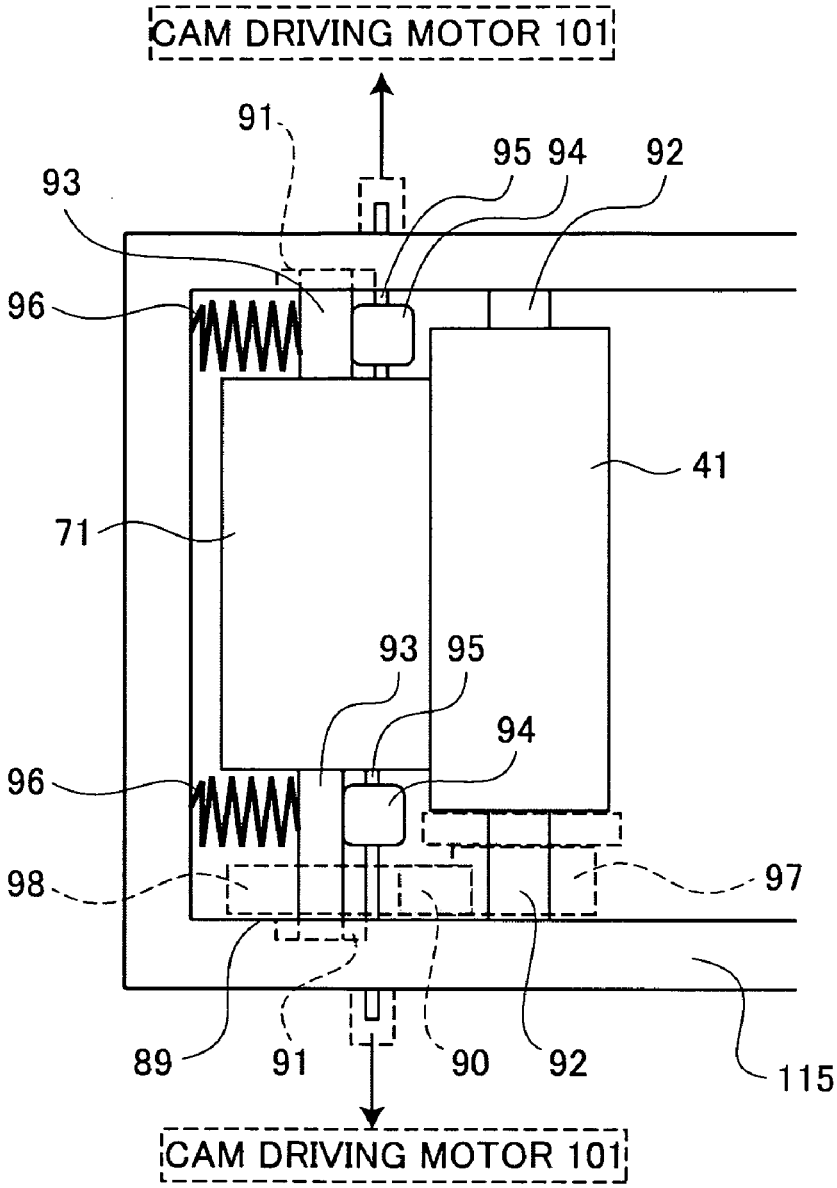
FIG. 3 is a cross sectional diagram describing a structure of an essential portion of the developing device according to the first embodiment.
Figure 4B:
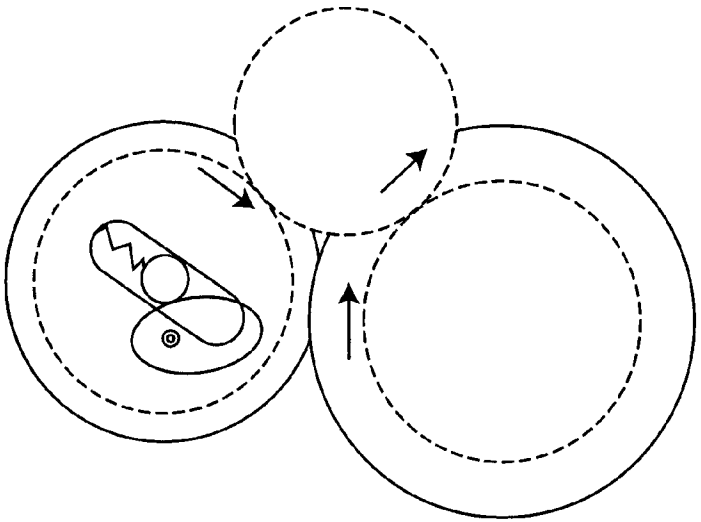
FIG. 4B is a diagram also describing the adjustment mechanism (the NIP portion pushing depth control mechanism)
Figure 4A:
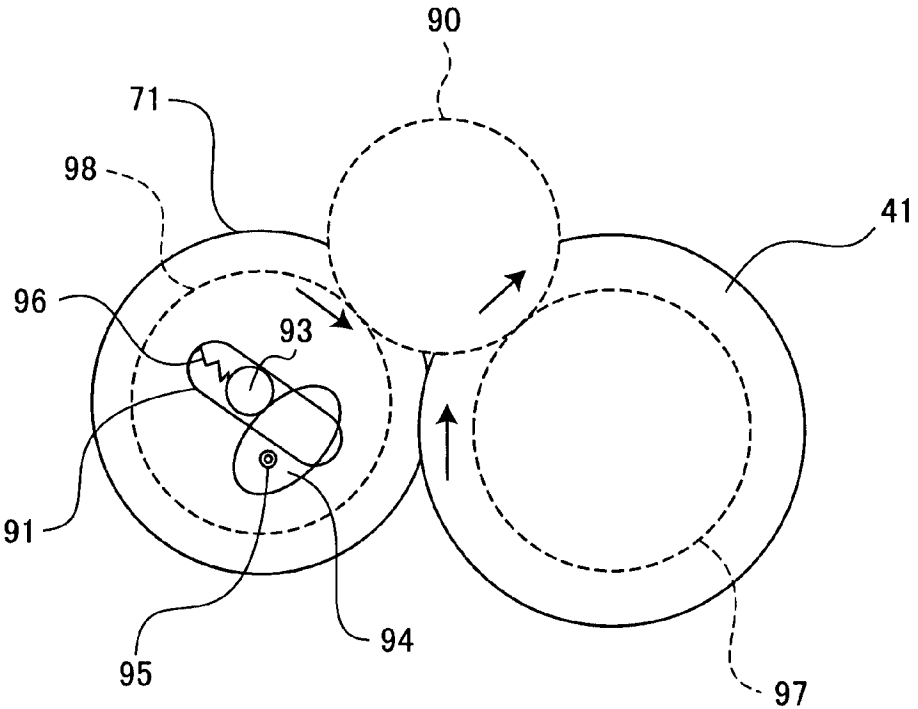
FIG. 4A is a diagram describing an adjustment mechanism (a NIP portion pushing depth control mechanism) adjusting an axial distance between rotational axes of a developing roller and a toner supply roller according to the first embodiment of the present invention.

The structure of the developing device 40 according to the present embodiment will be hereinafter described with reference to FIG. 3. FIG. 3 is a cross sectional diagram describing the structure of an essential portion of the developing device 40 according to the present embodiment. FIGS. 4A and 4B is a diagram describing an adjustment mechanism (the NIP portion pushing depth adjustment mechanism) adjusting the axial distance between the rotational axes of the developing roller 41 and the toner supply roller 71 according to the present embodiment. FIG. 4A shows the developing device 40 in an initial condition, such as factory default, of the developing device 40. FIG. 4B shows the developing device 40 in a worn condition when the toner supply roller is worn out.

The developing device 40 according to the present invention has the developing roller 41 having a developing roller shaft 92 and a developing roller driving gear 97, the toner supply roller 71 having a toner supply roller shaft 93 and a toner supply roller driving gear 98, an electrode 89, an idle gear 90, a cam 94, a cam shaft 95, and a spring 96, each of which are contained in a casing of the developing device 40. The spring 96 is arranged between an internal wall 115 of the casing and the toner supply roller shaft 93.

The toner supply roller driving gear 98, the idle gear 90, and the developing roller driving gear 97 are meshed with each other. A driving force provided by a photosensitive drum gear, not shown in the figures, is transmitted to the developing roller drive gear 97, and is transmitted to the toner supply roller drive gear 98 via the idle gear 90, so that each of the developing roller 41 and the toner supply roller 71 is rotated in a direction of the arrow shown in FIG. 4.

As shown in FIG. 3, an end portion of the toner supply roller shaft 93 is located within an elongated hole 91 arranged in the internal wall 115. The cam 94 supports the toner supply roller shaft 93 so that the end portion of the toner supply roller shaft 93 is held at a predetermined position in the elongated hole 91 against a pressing force of the spring 96. The cam 94 is connected with the cam shaft 95, and the cam is rotated by a driving force provided by the cam driving motor 101.

When the cam 94 is rotated, the toner supply roller shaft 93 can move within the elongated hole 91 according to the pressing force of the spring 96. Thus, the axial distance between the toner supply roller shaft 93 of the toner supply roller 71 and the developing roller shaft 92 of the developing roller 41 is adjusted, and the NIP portion pushing depth can be adjusted. FIG. 4B is a figure showing an example in a case where the axial distance is shortened between the toner supply roller 71 and the developing roller 41, as a result that the cam 94 is rotated to cause the toner supply shaft 93 to move toward the developing roller according to the pressing force of the spring 96 when the toner supply roller is worn out.

Next, the adjustment mechanism (the NIP portion pushing depth adjustment mechanism) will be hereinafter described that adjusts the axial distance between the rotational axes of the developing roller 41 and the toner supply roller 71 in the developing device 40 according to the present embodiment.

In a brand-new new condition such as factory default, the axial distance between the rotational axes of the developing roller 41 and the toner supply roller 71 is configured to be an initial condition, namely, an ideal interval, as shown in FIG. 4(*a*). It is assumed here, for example, that the radius of the toner supply roller 71 has thereafter decreased by 0.1 mm due to abrasion when the number of rotation of the toner supply roller 71 has reached a number equivalent to a case where 20,000 sheets of A4 size recording paper have been printed in transverse feeding. In this case, the printing control unit 99 provides the cam driving motor 101 with an instruction to rotate the cam 94. As a result, the toner supply roller shaft 93 moves toward the developing roller shaft 92 by 0.1 mm, so that the axial distance between the rotational axes is adjusted.

Specifically, when the brand-new image forming apparatus 1 begins to operate, or when the brand-new developing device 40*y* begins to operate, the number of printing Py memorized in the printing sheet counting unit 106 is 0 (zero). Every time the image forming apparatus 1 forms an image on the recording paper, the print control unit 99 adds the number of printing corresponding to the number of rotation of the toner supply roller 71 to the number of printing Py, and memorizes the new number of printing Py in the printing sheet counting unit 106.

The printing control unit 99 checks the number of printing Py memorized in the printing sheet counting unit 106 every time a printing operation finishes. When the number of printing Py reaches 2000 sheets, the printing control unit 99 determines that the number of rotation of the toner supply roller 71 has reached 7000 times, and provides the cam driving motor 101 with an instruction to rotate the cam 94. The printing control unit 99 reads the correction table 107 in the memory to determine a rotation angle of the cam 94, and moves the toner supply roller shaft 93 according to the pressing force of the spring 96. As a result, the axial distance between the rotational axes of the developing roller 41 and the toner supply roller 71 is adjusted, so that the NIP portion pushing depth is adjusted.

In a case where the NIP portion pushing depth formed by the toner supply roller 71 and the developing roller 41 overlapping with each other is not deep enough, the amount of toner attached to the developing roller 41 decreases to cause faint spots in the printed image, or on the contrary, the amount of toner attached to the developing roller 41 increases to cause smears on the printed image. The image forming apparatus according to the present embodiment can recover the printing quality from degradation caused by a lack of the NIP portion pushing depth. Similarly, the numbers of printing Pm, Pc, Pk in colors of magenta, cyan, black, respectively, are memorized in the printing sheet counting unit 106, and the printing control unit 99 checks the number of printing of each of them and determines whether the NIP portion pushing depth should be adjusted or not.

Figures 5A, 5B:
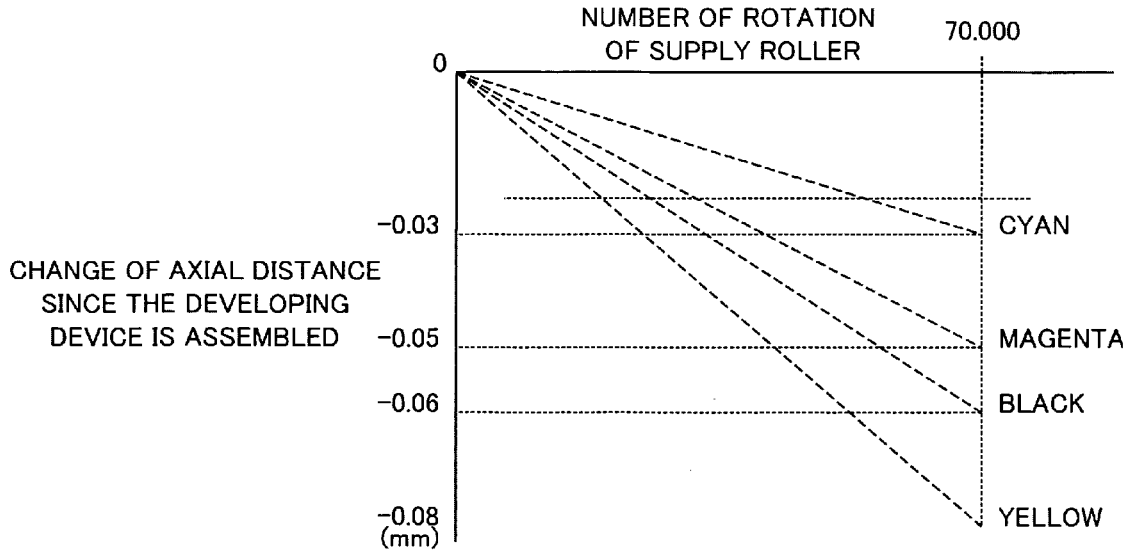
FIG. 5A is a table showing a result of a research on changes of the external diameter of the toner supply roller of the image forming apparatus.
FIG. 5B is a graph showing the result of the research on the changes of the external diameter of the toner supply roller of the image forming apparatus.

FIG. 5 shows a result of research on the change of the external diameter of the toner supply roller in an LED-type electrophotographic printer C8600dn manufactured by Oki Data Corporation. When the developing device has reached the end of its life, an average value of external diameters at three points decreased by approximately 0.06 to 0.16 mm compared with an initial value, although there are some differences among the toners in different colors. Accordingly, it can be understood that the NIP portion pushing depth of the toner supply roller with respect to the developing roller has decreased by approximately 0.03 (cyan) to 0.08 (yellow) mm (FIG. 5A). Here, the life of the developing device corresponds to 20000 pages of A4 size recording paper in transverse feeding, that is, 70000 rotations of the toner supply roller.

As shown in FIG. 5(*b*), the correction table 107 in the memory area 102 contains a relationship between the number of rotation of the toner supply roller in each color and the change of the axial distance from when the developing device is assembled (a displacement of the axial distance from the axial distance at the initial state). Using the correction table 107, the axial distance between the rotational axes of the toner supply roller and the developing roller can be obtained from the number of rotation of the toner supply roller. Thus, for example, when the number of rotation of the toner supply roller reaches 7000 rotations, the printing control unit 99 provides the cam driving motor 101 with an instruction to rotate the cam 94 to move the toner supply roller shaft 93 toward the developing roller shaft 92 (cyan:0.003 mm, magenta:0.005 mm, black:0.006 mm, yellow:0.008 mm) so as to adjust the axial distance between the rotational axes of the toner supply roller 71 and the developing roller 41. In this way, the axial distance between the rotational axes is adjusted every 7000 rotations, depending on the color, so that the axial distance between the rotational axes are kept normal.

As hereinabove described, the image forming apparatus according to the first embodiment of the present invention adjusts the axial distance between the rotational axes of the toner supply roller and the developing roller, and can recover the NIP portion lost by the abrasion of the toner supply roller to an appropriate condition, thus capable of preventing degradation in the printing quality.

Second Embodiment

The image forming apparatus according to the first embodiment can adjust the NIP portion pushing depth formed by the toner supply roller 71 and the developing roller 41 and can sufficiently prevent degradation in the printing quality, but there may be a case where the image is degraded because of a manufacturing error of the toner supply roller or an installation and operation environment of the image forming apparatus. This is because an environmental change of a rubber material varies a pressure applied on the developing roller by the toner supply roller and causes non-uniformity in a toner density on the developing roller, and also because a charging characteristic of the toner varies depending on the environment.

Especially, in order to keep the toner density on the developing roller to be constant, it is preferable to keep the pressure applied on the developing roller by the toner supply roller to be uniform on all over the developing roller. Accordingly, the toner supply roller is in a shape of a convexly curved pillar having a diameter of 15.8 mm at both ends and having a diameter of 16.2 mm at its center as shown in FIG. 7B when the toner supply roller is detached from the developing device. On the other hand, when the toner supply roller 71 is not installed on the image forming apparatus, the toner supply roller 71 is in a bent shape because the toner supply roller 71 is pushed toward the developing roller at both axial ends (FIG. 7A).

Figure 7A:
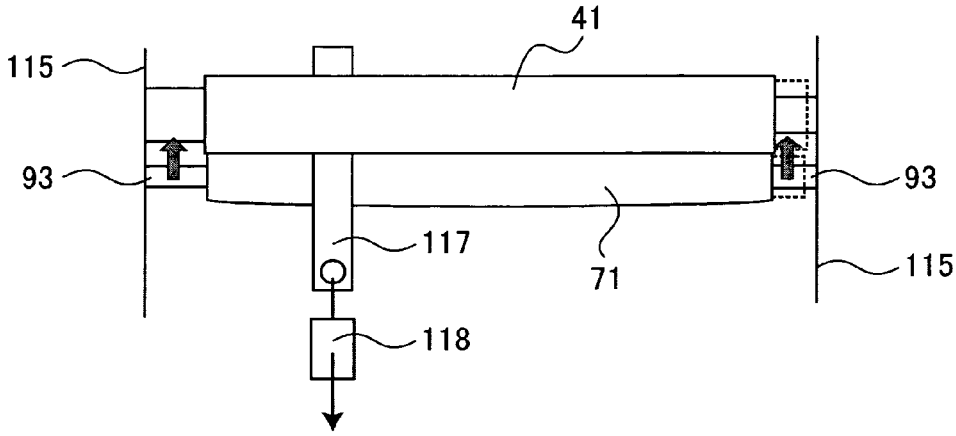
FIG. 7A is a diagram describing a shape of the toner supply roller according to the second embodiment of the present invention when the toner supply roller is attached to the developing device.
Figure 7B:
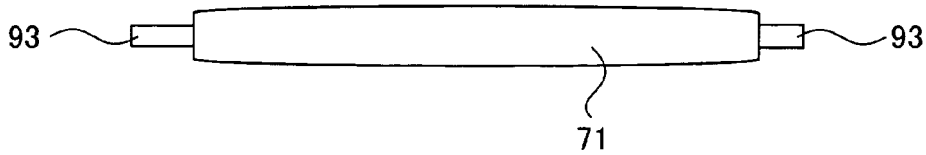
FIG. 7B is a diagram describing a shape of the toner supply roller according to the second embodiment of the present invention when the toner supply roller is detached from the developing device.
Figure 8:
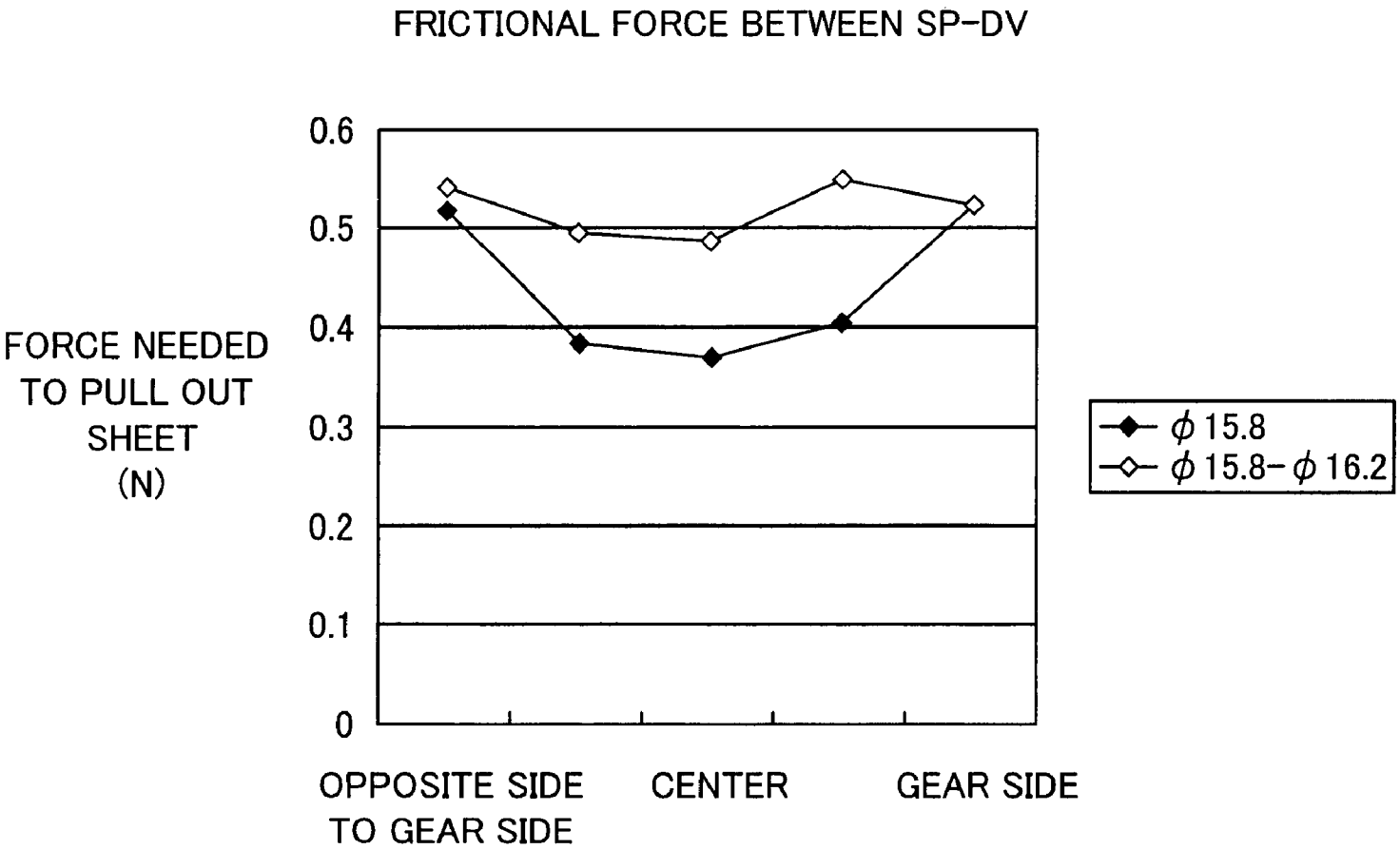
FIG. 8 is a graph showing a measurement result of a pressure applied on the developing roller 41 by the toner supply roller 71 according to the second embodiment of the present invention.

FIGS. 7A and 7B and FIG. 8 show evaluations of the pressure applied on the developing roller 41 by the toner supply roller 71 when the toner supply roller 71 is installed on the image forming apparatus. A polypropylene film of a width of 5 mm and a thickness of 0.04 mm was sandwiched between the toner supply roller 71 and the developing roller 41, and the sandwiched film was pulled with a tension gauge (Digital Gauge Model RX manufactured by Aikoh Engineering Co., Ltd.) and the tensional force was measured. As shown in FIG. 8, the result of the measurement has showed that the toner supply roller 71 in the convexly curved pillar shape (having the diameter 15.8-16.2 mm) applied to the developing roller 41*a* pressure substantially uniform with respect to the axial direction. On the other hand, a straight toner supply roller having a diameter 15.8 provides a smaller friction and applies a lower pressure in the center portion of the roller.

As described above, the convexly curved toner supply roller 71 keeps the toner density on the developing roller to be substantially constant, but the rubber material in the toner supply roller 71 deforms as the installation and operational environment of the image forming apparatus changes. FIGS. 9A to 9B show evaluations of the influence exerted by the environmental changes on the NIP portion pushing depth in the LED-type electrophotographic printer C8600dn manufactured by Oki Data Corporation. The influence is evaluated based on (A) a toner potential on the developing roller (a DV potential) (FIG. 9A), (B) faint spots (FIG. 9B), and (C) smears caused by 2×2 pattern printing (FIG. 9C).

(A) The toner potential on the developing roller (the DV potential) is measured with a detection electrode of a surface potentiometer (MODEL-344 manufactured by Trek Japan KK) placed at approximately 1 to 2 mm from the toner on the developing roller, so that the toner potential on the developing roller is measured. (B) The faint spots are evaluated by printing a solid-fill (100% printing density) and visually inspecting vertical streaks in parallel to a paper advancing direction and low density portions (traverse band form) appearing in a cycle of a sponge roller. In FIG. 9B, the evaluated score is X (not good) if the faint spots are perceived in one tenths (1/10) or more of a printing area, and the evaluated score is O (good) if the faint spots are less than one tenths (1/10) thereof. (C) The smears caused by 2×2 printing is evaluated by printing 2×2 dots and checking if a smear can be perceived. That is, if a toner is attached to white background other than the dot-formed area and the density in the entire printing area increases, it is determined as a 2×2 smear. In a case where the 2×2 smear occurs, the evaluated score is determined as X (not good) if the printing density increases by 20% or more compared with a reference density when there is no 2×2 smear at all, and the evaluated score is determined as O (good) if there is no 2×2 smear, namely, if the increase in the printing density is less than 20%. It should be noted that a 2×2 pattern is formed in a 4 by 4 square area having 16 pixels and the 2×2 pattern occupies 4 pixels therein.

Under an NN (temperature 25 degrees Celsius, humidity 50%) environment, the toner potential is −87V when the NIP portion pushing depth is at a reference position, and any faint spots, smears, and the like did not occur in the printed image. When the NIP portion pushing depth of the toner supply roller is plus or minus 0.1 mm with respect to the reference position, any faint spots, smears, and the like did not occur in the printed image.

Under an HH (temperature 28 degrees Celsius, humidity 80%) environment, the toner potential is −47V when the NIP portion pushing depth is at the reference position, and any faint spots, smears, and the like did not occur in the printed image. However, when the NIP portion pushing depth is +0.1 mm, a smear has appeared in the printed image. At this moment, the toner potential is −12V, and it is presumed that the decrease in the toner potential caused a decrease in the amount of toner attached to the developing roller.

Under an LL (temperature 10 degrees Celsius, humidity 20%) environment, the toner potential is −80V when the NIP portion pushing depth is at the reference position, and any faint spots, smears, and the like did not occur in the printed image. However, when the NIP portion pushing depth is −0.1 mm, a smear has appeared in the printed image. At this moment, the toner potential is −91V, and it is presumed that the increase in the toner potential caused an increase in the amount of toner attached to the developing roller.

As the above experimental result shows, the degradation in the printing quality in various environmental changes can be improved by shifting the NIP portion pushing depth of the toner supply roller by plus or minus 0.1 mm from the reference position. Thus, the image forming apparatus according to the present embodiment measures the environmental change such as surrounding temperature, humidity, or the like using an environmental sensor 112, and adjusts the axial distance between the rotational axes of the developing roller 41 and the toner supply roller 71 based on a result of the measurement.

The second embodiment of the present invention is characterized by having the environmental sensor 112 in addition to the image forming apparatus according to the first embodiment. The environmental sensor 112 is arranged in the inside of or in proximity to the outside of the developing device 40, and measures the temperature or the humidity of the developing device 40.

Figure 6:
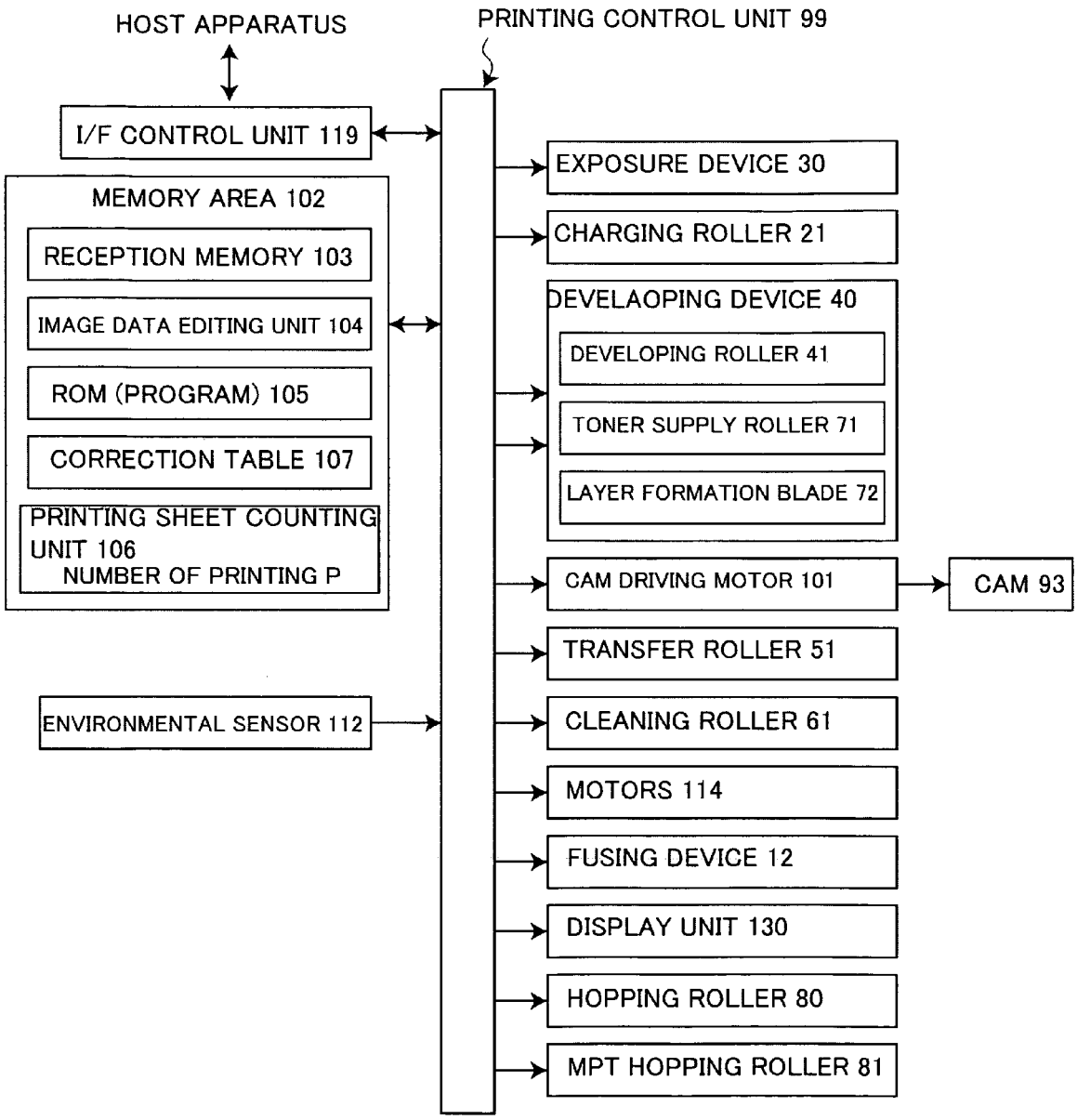
FIG. 6 is a block diagram describing a circuit configuration for a printing control according to the second embodiment of the present invention.

The image forming apparatus according to the second embodiment has substantially the same structure as the image forming apparatus according to the first embodiment. Thus, the same portions as the first embodiment are omitted from the description below, and only portions different from the first embodiment will be hereinafter described. FIG. 6 is a block diagram describing a circuit configuration for a printing control according to the second embodiment of the present invention. In addition to the elements of the image forming apparatus according to the first embodiment, the image forming apparatus according to the second embodiment has the environmental sensor 112 for measuring the temperature or the humidity of the developing device 40.

The environmental sensor 112 is not especially limited, but a thermistor and the like can be used in a case where the temperature is measured, and a polymer membrane humidity sensor and the like can be used in a case where the humidity is measured.

The image formation process of the image forming apparatus according to the second embodiment of the present invention is substantially the same as the process of the image forming apparatus according to the first embodiment.

When a printing instruction is inputted to the printing control unit 99 of the image forming apparatus 1 via the I/F control unit 119, the printing control unit 99 provides the environmental sensor 112 with an instruction to read an environmental change such as temperature, humidity, or the like around the device. Then, the printing control unit 99 reads the numbers of printing Py, Pm, Pc, Pk memorized in the printing sheet counting unit 106 in the similar manner to the first embodiment.

The printing control unit 99 having read the environmental change and the numbers of printing looks up the correction table 107 in the memory area 102 to read the appropriate axial distance between the rotational axes of the developing roller 41 and the toner supply roller 71. The correction table 107 used at this moment previously configures and memorizes the appropriate axial distance between the rotational axes according to the numbers of sheets having been printed and the environmental change.

The printing control unit 99 provides the cam driving motor 101 with an instruction to rotate the cam 94 based on the appropriate axial distance read out of the correction table 107. The printing control unit 99 determines the rotational angle of the cam 94 upon reading the correction table 107 in the memory area 102, and the pressing force of the spring 96 moves the toner supply roller shaft 93. As a result, the axial distance between the rotational axes of the developing roller 41 and the toner supply roller 71 is adjusted, so that the NIP portion pushing depth is adjusted.

Figure 10B:
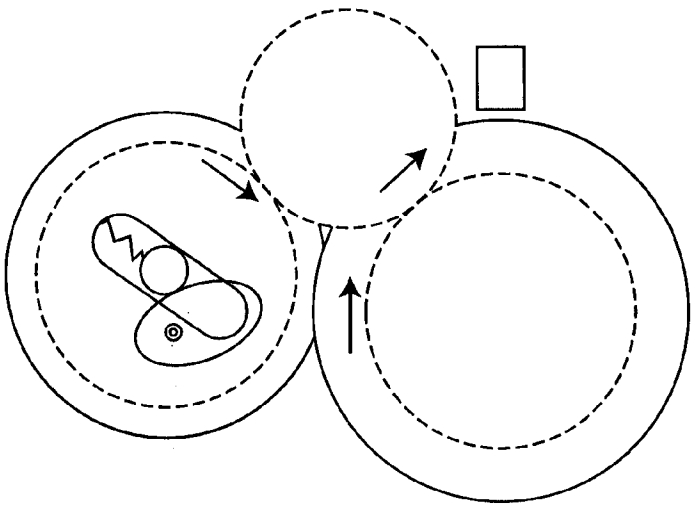
FIG. 10B is a diagram describing the adjustment mechanism (the NIP portion pushing depth control mechanism) according to the second embodiment under an LL environment.
Figure 10A:
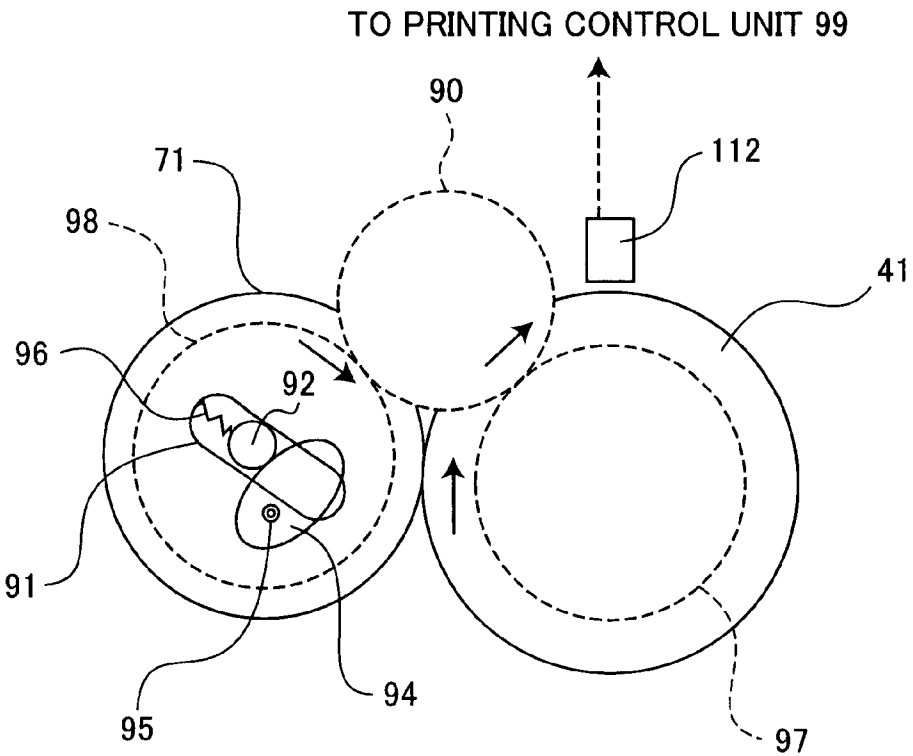
FIG. 10A is a diagram describing the adjustment mechanism (the NIP portion pushing depth control mechanism) according to the second embodiment under an HH environment.

FIGS. 10A to 10B are figures describing how the axial distance is changed between the developing roller 41 and the toner supply roller 71 according to the second embodiment of the present invention. FIG. 10A shows the developing device 40 under a high temperature and highly humid (HH) environment. FIG. 10B shows the developing device 40 under a low temperature and low humidity (LL) environment.

Specifically, under the HH environment decreasing the toner voltage and the amount of toner attached to the developing roller 41 and causing faint spots, the printing control unit 99 provides the cam driving motor 101 with an instruction to make the NIP portion pushing depth be smaller (+0.1 mm or less with respect to the reference position) (FIG. 10A). On the other hand, under the LL environment increasing the toner voltage and the amount of toner attached to the developing roller 41 and causing smears, the printing control unit 99 provides the cam driving motor 101 with an instruction to make the NIP portion pushing depth be larger (−0.1 mm or more with respect to the reference position) (FIG. 10B).

Figure 11:
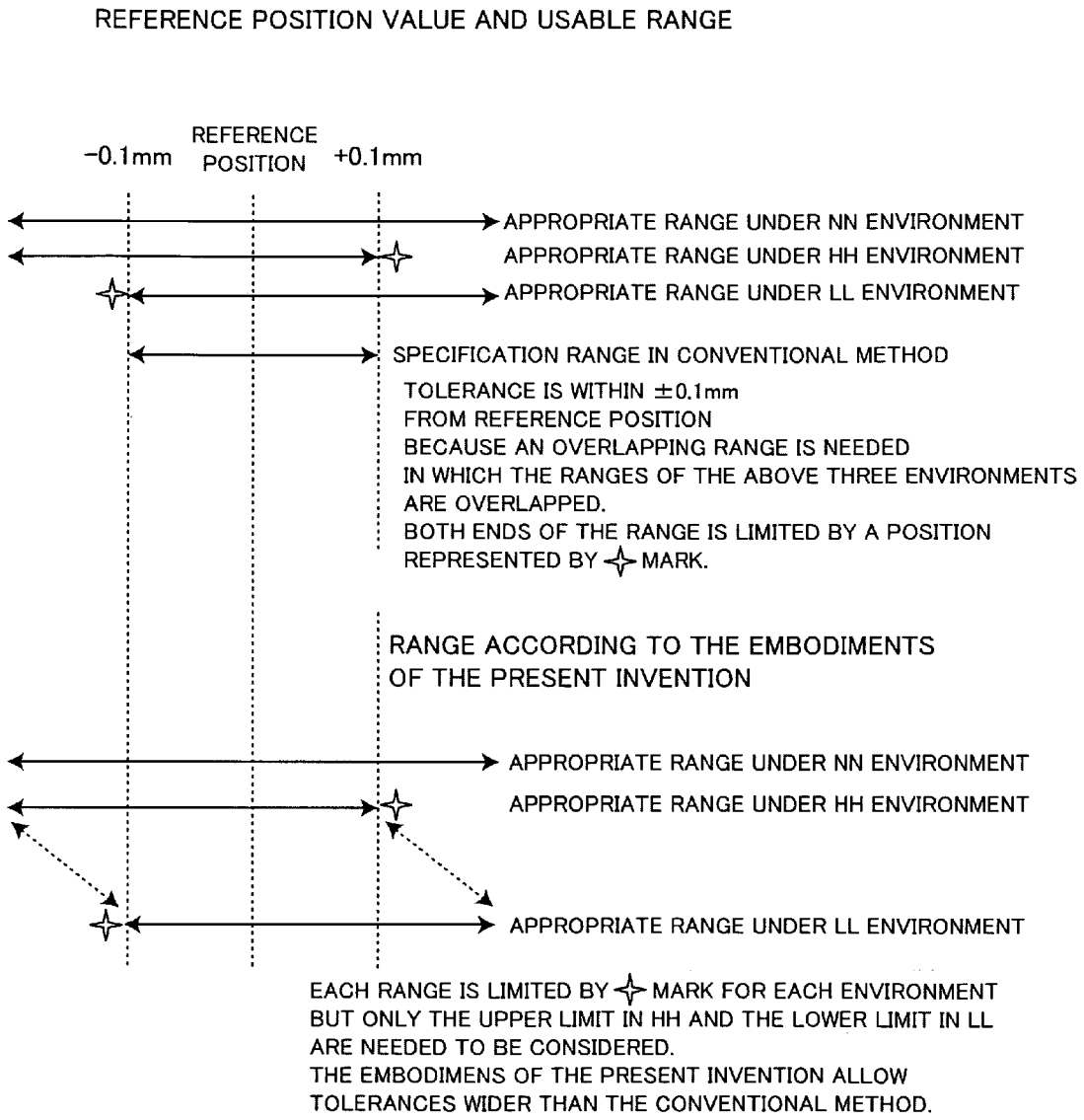
FIG. 11 is a diagram showing an environmental correction according to the second embodiment of the present invention.

FIG. 11 is a figure describing an environmental correction according to the second embodiment of the present invention. In a conventional environmental correction method, available correction range with respect to the reference position of the NIP portion pushing depth is restricted (within plus or minus 1 mm) according to the NN, HH, LL environments. On the other hand, in the environmental correction method according to the second embodiment of the present invention, only the upper limit in the HH environment and the lower limit in the LL environment are needed to be considered, and large errors can be allowed compared with the conventional environmental correction method.

Thus, the large manufacturing tolerances can be allowed in the toner supply roller, and the toner supply roller enjoys a cost reduction effect.

Third Embodiment

The image forming apparatus according to the first embodiment and the image forming apparatus according to the second embodiment can sufficiently prevent degradation in the printing quality by correcting the NIP portion consisted of the toner supply roller 71 and the developing roller 41, but the manufacturing tolerances of rollers such as the developing rollers and the toner supply roller may cause degradation in the printed image due to inappropriateness in the external diameters of the developing roller and the toner supply roller, a surface roughness of the developing roller, a surface friction coefficient, a manufactured rubber hardness of the toner supply roller, and the like.

The image forming apparatus according to the third embodiment of the present invention is characterized by having a surface potential sensor 113 in addition to the image forming apparatus according to the first embodiment and the image forming apparatus according to the second embodiment. The surface potential sensor 113 is arranged in the developing device 40 to measure the potential of the toner layer on the surface of the developing roller 41 relative to the developing roller shaft 92 as a ground.

Figure 12:
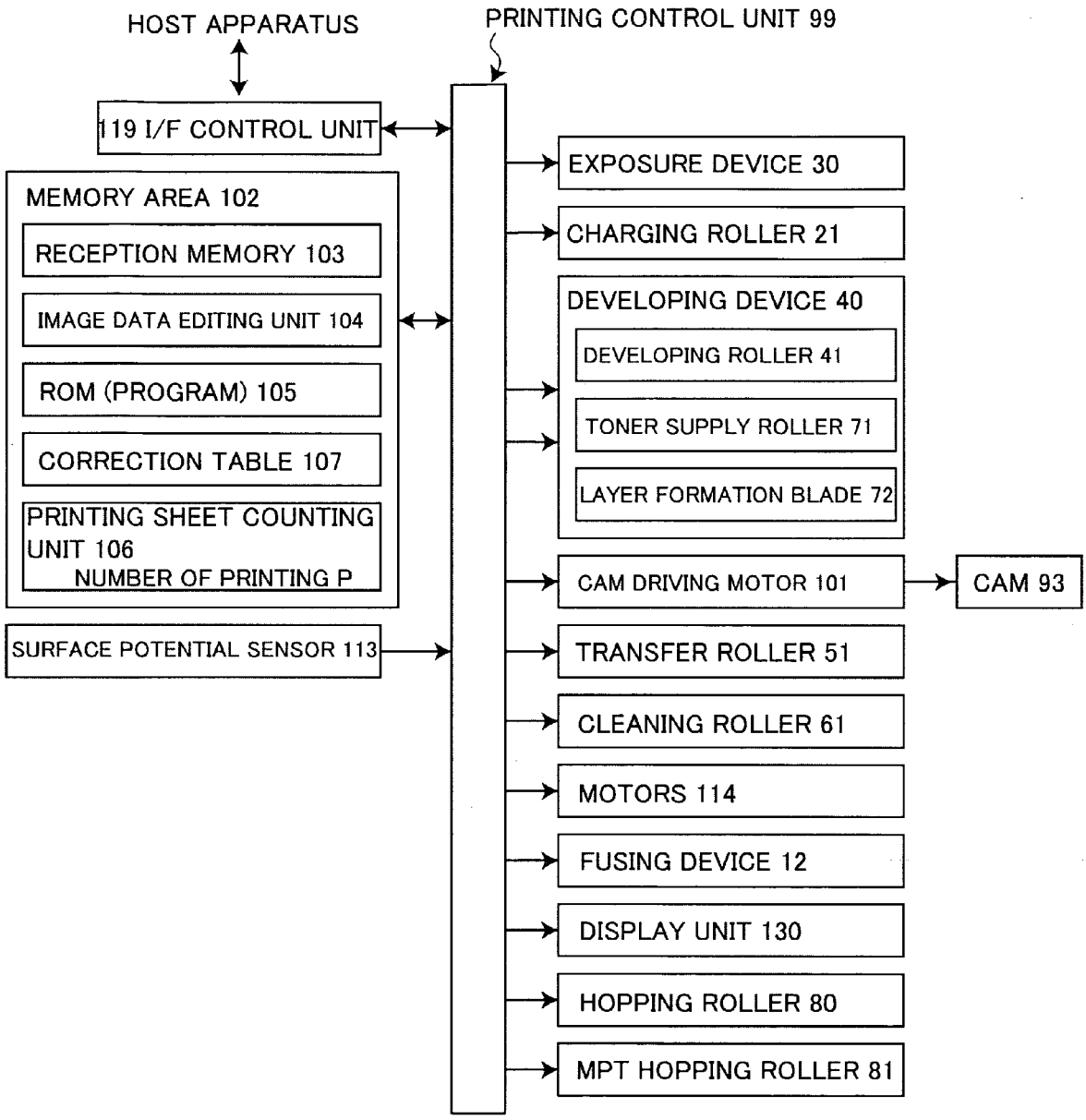
FIG. 12 is a block diagram describing a circuit configuration for a printing control according to the third embodiment of the present invention.
Figure 13:
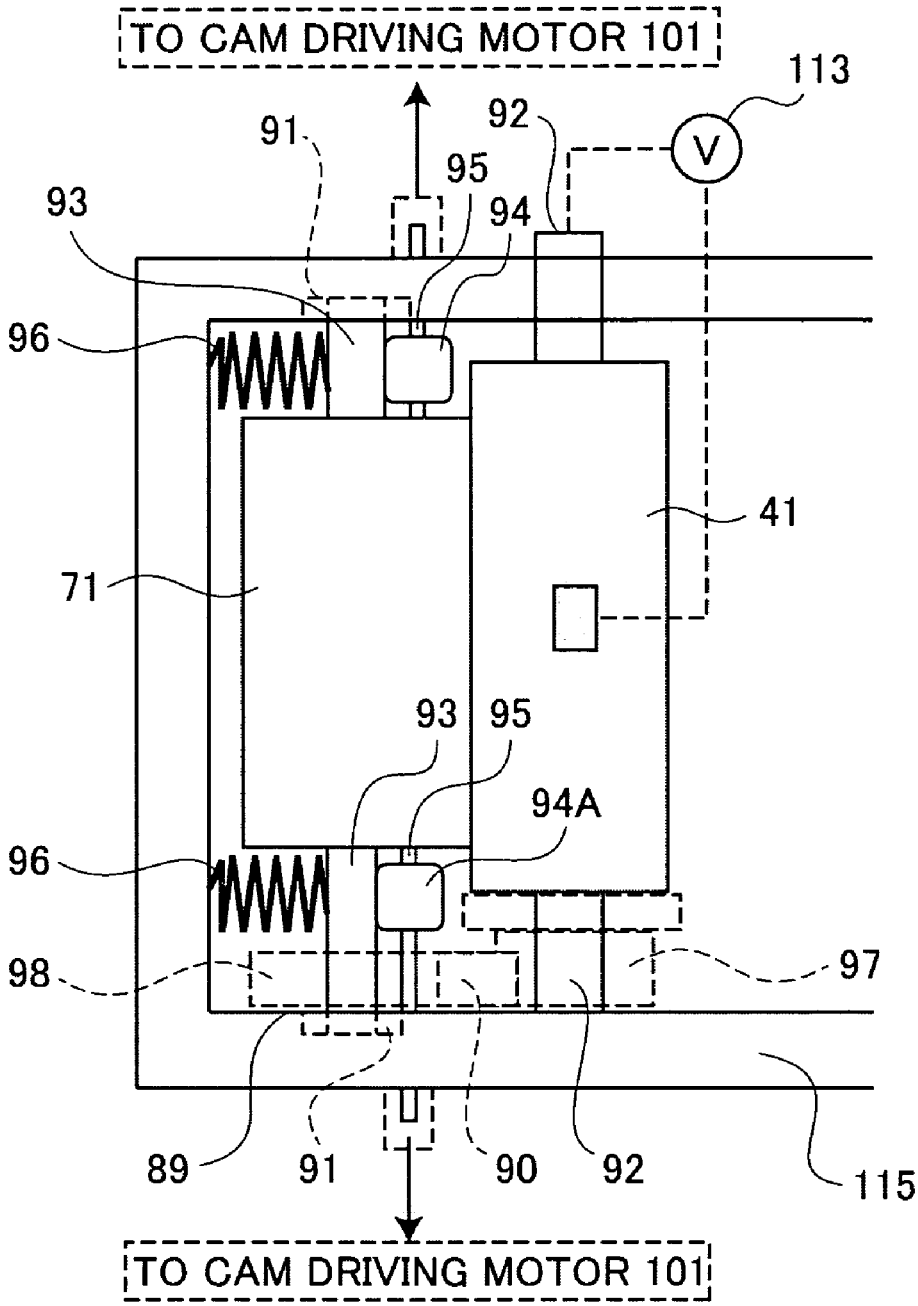
FIG. 13 is a cross sectional diagram describing a structure of the essential portion of the developing device according to the third embodiment of the present invention.

The structure of the image forming apparatus according to the third embodiment of the present invention has substantially the same structure as the image forming apparatus according to the first embodiment and the image forming apparatus according to the second embodiment. Thus, the same portions as the first and second embodiments are omitted from the description below, and only portions different from the first and second embodiments will be hereinafter described. FIG. 12 is a block diagram describing a circuit configuration for a printing control according to the third embodiment of the present invention. FIG. 13 is a cross sectional diagram describing a configuration of the essential portion of the developing device 40 according to the third embodiment of the present invention. In addition to the elements of the image forming apparatus 1 according to the first and second embodiments, the image forming apparatus 1 has a surface potential sensor 113 for measuring the potential of the toner layer on the surface of the developing roller 41.

The surface potential sensor 13 is not especially limited, but a one having functions equivalent to a surface potentiometer MODEL 344 manufactured by Trek Japan KK and the like can be used as the surface potential sensor 13. The surface potential sensor 113 measures the toner potential of the developing roller 41*y*, so as to presume, e.g., an environment around the image forming apparatus 1, a degree of abrasion of the developing device 40, a capability to charge the toner on the developing roller 41*y* at the current NIP portion pushing depth between the developing roller 41*y* and the toner supply roller 71*y*.

The image formation process performed by the image forming apparatus according to the third embodiment of the present invention is substantially the same as the process performed by the image forming apparatus according to the first and second embodiments.

When a printing instruction is inputted to the printing control unit 99 of the image forming apparatus 1 via the I/F control unit 119, the printing control unit 99 provides an instruction to apply a direct-current charging voltage from the charging device power source 22*y* to the charging roller 21*y*. The voltage applied to the charging roller 21*y* charges the photosensitive drum 11*y*. The printing control unit 99 gives an instruction to apply a direct-current voltage, in the same polarity as the voltage applies to the charging roller 21*y*, from the developing device power source 42*y* to the developing roller 41*y*.

The printing control unit 99 gives an instruction to apply a direct-current voltage, in the same polarity as the voltage applied to the charging roller 21*y*, from the toner supply device power source 73*y* to the toner supply roller 71*y* and the layer formation blade 72*y*. The printing control unit 99 gives an instruction to apply a direct-current voltage, in the polarity opposite to the voltage applied to the charging roller 21*y*, from the cleaning device power source 62*y* to the cleaning roller 61*y*

In this way, the developing roller 41*y*, the toner supply roller 71*y*, and the photosensitive drum 11*y* are made in the same condition as when the printing operation is performed. Regarding the voltage applied to the developing roller 41*y* and the toner supply roller 71, it should be noted that an specifically defined constant voltage is applied thereto, for example, −200V is applied to the developing roller 41*y*, and −270V is applied to the toner supply roller 71*y*.

Next, the printing control unit 99 provides the surface potential sensor 113 with an instruction to measure the toner potential of the developing roller 41*y*. The printing control unit 99 reads out the number of printing Py memorized in the printing sheet counting unit 106 in the similar manner to the first and second embodiments.

The printing control unit 99 looks up the correction table in the memory area 102 based on information about the measured toner potential and the number of printing Py, and reads out the appropriate axial distance between the rotational axes of the developing roller 41*y* and the toner supply roller 71*y*. The correction table 107 used at this moment previously configures and memorizes the appropriate axial distance between the rotational axes according to the numbers of sheets having been printed and the toner potential.

The printing control unit 99 provides the cam driving motor 101 with an instruction to rotate the cam 94 based on the appropriate axial distance read out of the correction table 107. The printing control unit 99 determines the rotational angle of the cam 94 upon reading the correction table 107 in the memory area 102, and the pressing force of the spring 96 moves the toner supply roller shaft 93. As a result, the axial distance between the rotational axes of the developing roller 41 and the toner supply roller 71 is adjusted, so that the NIP portion pushing depth is adjusted.

Figure 14B:
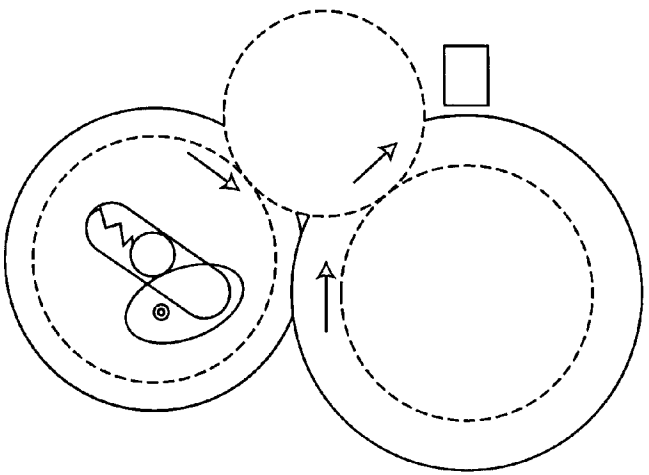
FIG. 14 is a figure showing how the axial distance is changed between rotational axes of the developing roller and the toner supply roller according to the third embodiment of the present invention.
Figure 14A:
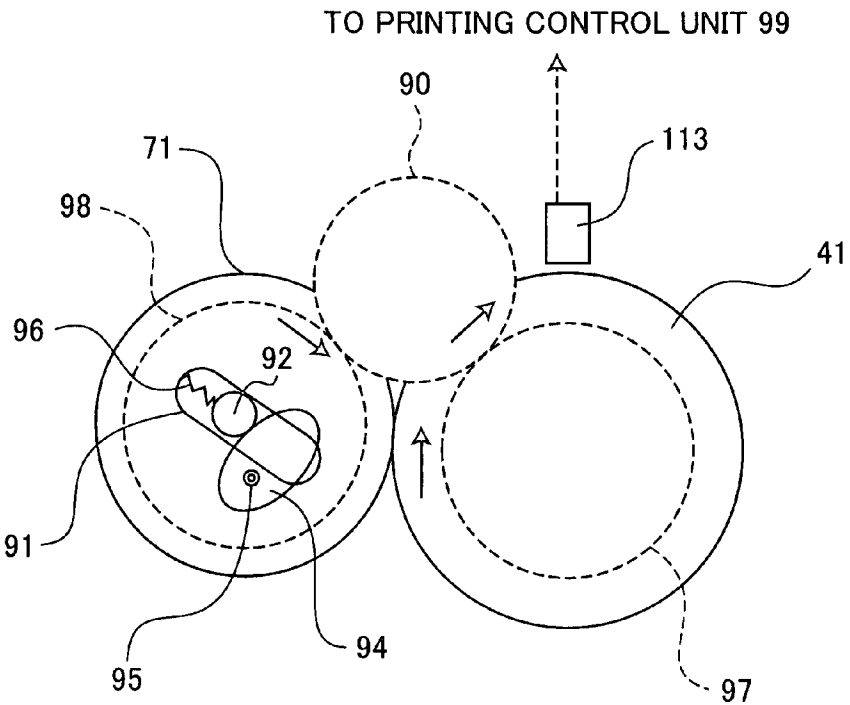

FIGS. 14A to 14B are figures describing how the axial distance is changed between the developing roller 41 and the toner supply roller 71 according to the second embodiment of the present invention. FIG. 14A shows the developing device 40 when the toner potential on the developing roller is perceived as low. FIG. 14B shows the developing device 40 when the toner potential on the developing roller is perceived as high.

Specifically, in a case where the measured toner potential is less than a standard potential memorized in the correction table 107, the printing control unit 99 provides the cam driving motor 101 with an instruction to separate the toner supply roller 71*y* from the developing roller 41*y* to decrease the NIP portion pushing depth so as to increase the toner voltage on the developing roller 41*y*. On the other hand, in a case where the measured toner potential is more than a standard potential memorized in the correction table 107, the printing control unit 99 provides the cam driving motor 101 with an instruction to move the toner supply roller 71*y* toward the developing roller 41*y* to increase the NIP portion pushing depth so as to decrease the toner voltage on the developing roller 41*y*. The same operation is also done for the developing devices 40*m*, 40*c*, 40*k*.

As hereinabove described, the image forming apparatus according to the third embodiment of the present invention can improve the printing quality by correcting the toner charging according to a condition in which the printing operation is performed, even in a case where manufacturing errors of rollers such as the developing roller and the toner supply roller causes the external diameters of the developing roller and the toner supply roller, a surface roughness of the developing roller, a surface friction coefficient, a manufactured rubber hardness of the toner supply roller, and the like to deviate from ideal values.

The printing quality may be improved if a high-precision specification is satisfied in the manufacture of the toner supply roller. In contrast, the image forming apparatus according to the third embodiment can control the printing quality to be constant by adjusting the NIP portion pushing depth with respect to the developing roller, thus allowing large manufacturing tolerances in the toner supply roller without needing to satisfy the high-precision specification.

Figure 15:
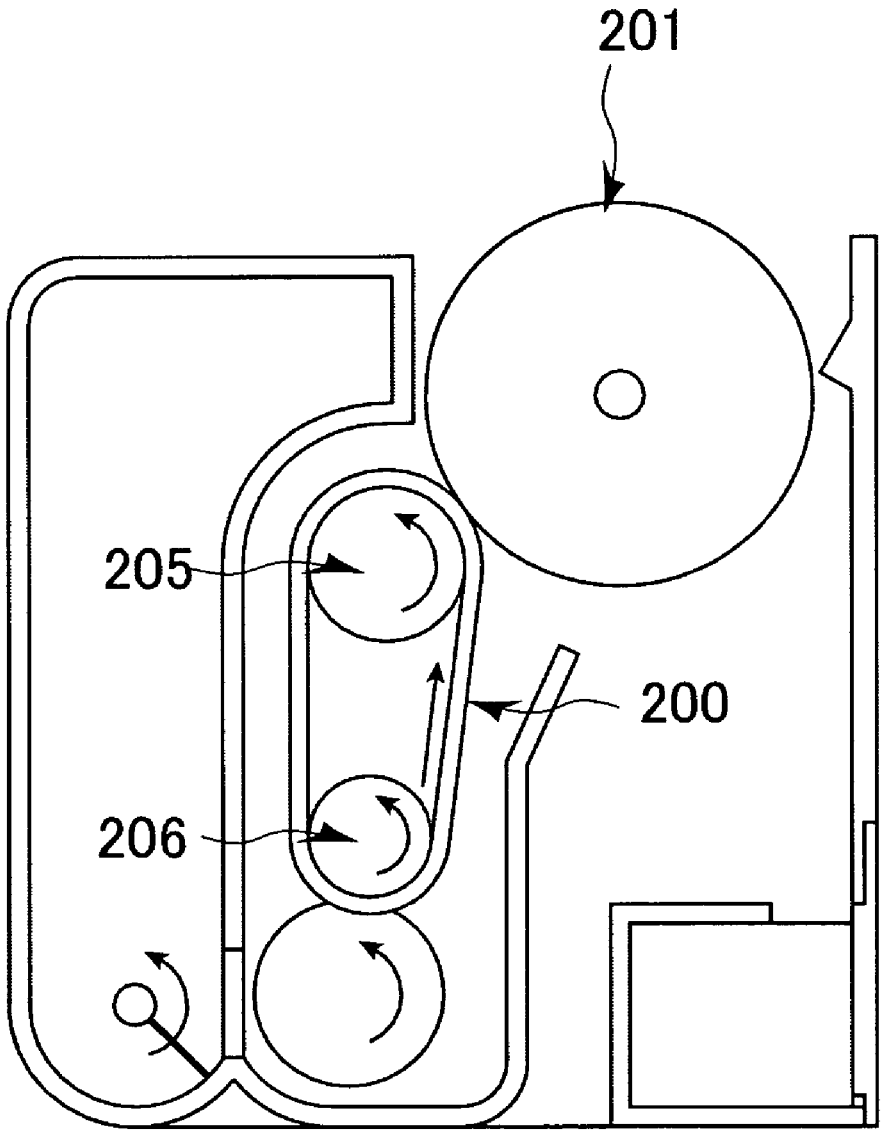
FIG. 15 is a figure showing an example of a developing device consisting of a toner supply belt and a developing roller.
Figure 16:
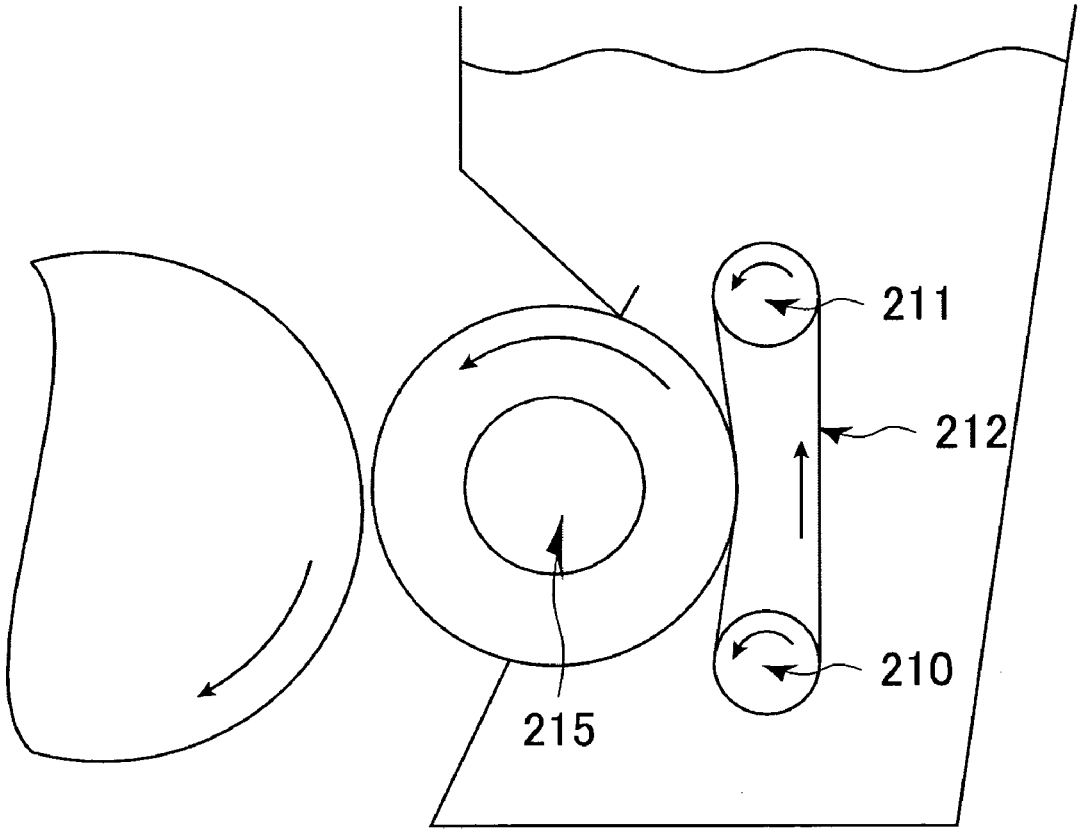
FIG. 16 is a figure describing how the adjustment is made between the toner supply belt and the developing roller.

In the embodiments as described above, the distance between the developing roller and the toner supply roller is adjusted, but the present invention is not limited thereto. The present invention can also be applied to the adjustment of the distance between the developing roller and a toner supply belt, between a developing belt and the toner supply roller, between the developing belt and the toner supply belt, and the like. FIG. 15 shows an example of the developing device consisting of the toner supply belt 200 and the developing roller 201. The adjustment may be made by moving a belt holding member including the toner supply belt 200 and rollers 205 and 206 as shown in FIG. 15 or by moving at least one roller 210 or 211 for tensioning the belt as shown in FIG. 16. As shown in FIG. 16, a contact between a toner supplying roller 215 and a toner supplying belt 212 can be adjusted by moving at least one of the rollers 210 and 211.

In the embodiments as described above, the adjustment between the developing roller and the toner supply roller is made by moving the toner supply roller. However, the adjustment can also be made by moving the developing roller instead of moving the toner supply roller.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus comprising:

a developing agent holder arranged as opposed to an image holder having an electrostatic latent image formed thereon, the developing agent holder attaching a developing agent to the image holder;

a developing agent supplying unit rotatably arranged in contact with the developing agent holder, the developing agent supplying unit supplying the developing agent to the developing agent holder, at least one of the developing agent holder and the developing agent supplying unit being in a belt shape and has at least two tensioning members; and an adjustment unit capable of adjusting a contacting state between the developing agent holder and the developing agent supplying unit, the adjustment unit moving at least one of the two tensioning members.

2. The image forming apparatus according to claim 1, wherein an adjustment amount resulting from the adjustment unit adjusting the contacting state is dependent on a color of the developing agent, with different colors requiring different adjustment amounts.

3. An image forming apparatus, comprising:

a developing agent holder arranged as opposed to an image holder having an electrostatic latent image formed thereon, the developing agent holder attaching a developing agent to the image holder;

a developing agent supplying unit rotatably arranged in contact with the developing agent holder, the developing agent supplying unit supplying the developing agent to the developing agent holder;

a temperature detection unit adapted to detect a temperature in the image forming apparatus; and an adjustment unit capable of adjusting a contacting state between the developing agent holder and the developing agent supplying unit, the adjustment unit adjusting the contacting state based on the temperature detected by the temperature detection unit.

4. The image forming apparatus according to claim 3, wherein the adjustment unit moves the developing agent supplying unit.

5. The image forming apparatus according to claim 4, wherein the adjustment unit has an eccentric cam and an elastic body to move a rotational axis of the developing agent supplying unit.

6. The image forming apparatus according to claim 3, wherein the adjustment unit adjusts the contacting state based on a number of printing or a number of rotation of the developing agent supplying unit.

7. The image forming apparatus according to claim 3, wherein each of the developing agent holder and the developing agent supplying unit is in a roller shape.

8. The image forming apparatus according to claim 3, wherein at least one of the developing agent holder and the developing agent supplying unit has a belt shape having a belt supporting unit, and wherein the adjustment unit moves the belt supporting unit.

9. The image forming apparatus according to claim 3, wherein the adjustment unit moves the developing agent holder.

10. The image forming apparatus according to claim 3, wherein an adjustment amount resulting from the adjustment unit adjusting the contacting state is dependent on a color of the developing agent, with different colors requiring different adjustment amounts.

11. An image forming apparatus, comprising:

a developing agent holder arranged as opposed to an image holder having an electrostatic latent image formed thereon, the developing agent holder attaching a developing agent to the image holder;

a developing agent supplying unit rotatably arranged in contact with the developing agent holder, the developing agent supplying unit supplying the developing agent to the developing agent holder;

a humidity detection unit adapted to detect a humidity in the image forming apparatus; and an adjustment unit capable of adjusting a contacting state between the developing agent holder and the developing agent supplying unit, the adjustment unit adjusting the contacting state based on the humidity detected by the humidity detection unit.

12. The image forming apparatus according to claim 11, wherein an adjustment amount resulting from the adjustment unit adjusting the contacting state is dependent on a color of the developing agent, with different colors requiring different adjustment amounts.

13. An image forming apparatus, comprising:

a developing agent holder arranged as opposed to an image holder having an electrostatic latent image formed thereon, the developing agent holder attaching a developing agent to the image holder;

a developing agent supplying unit rotatably arranged in contact with the developing agent holder, the developing agent supplying unit supplying the developing agent to the developing agent holder, a surface potential detection unit adapted to detect a surface potential of the developing agent holder; and an adjustment unit capable of adjusting a contacting state between the developing agent holder and the developing agent supplying unit, the adjustment unit adjusting the contacting state based on the potential detected by the surface potential detection unit.

14. The image forming apparatus according to claim 13, wherein an adjustment amount resulting from the adjustment unit adjusting the contacting state is dependent on a color of the developing agent, with different colors requiring different adjustment amounts.

* * * * *